US006618918B2

(12) United States Patent
Reiter et al.

(10) Patent No.: US 6,618,918 B2
(45) Date of Patent: Sep. 16, 2003

(54) DISMANTLING DEVICE FOR DISMANTLING A FUEL INJECTOR

(75) Inventors: Ferdinand Reiter, Markgroeningen (DE); Heinz-Martin Krause, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/113,655

(22) Filed: Mar. 28, 2002

(65) Prior Publication Data

US 2002/0108223 A1 Aug. 15, 2002

Related U.S. Application Data

(62) Division of application No. 09/600,713, filed as application No. PCT/DE99/02472 on Aug. 7, 1999, now Pat. No. 6,397,445.

(30) Foreign Application Priority Data

Nov. 20, 1998 (DE) ..... 198 53 586

(51) Int. Cl.[7] ..... B25B 27/16
(52) U.S. Cl. ..... 29/213.1; 29/278
(58) Field of Search ..... 29/219, 282, 267, 29/278, 280, 270, 213.1; 254/25, 28, 131

(56) References Cited

U.S. PATENT DOCUMENTS

| | | | | |
|---|---|---|---|---|
| 144,074 A | | 10/1873 | Douglass | |
| 949,337 A | | 2/1910 | Trogner | |
| 3,739,452 A | | 6/1973 | Gadberry | |
| 4,050,148 A | * | 9/1977 | Hastings | 29/278 |
| 4,293,992 A | | 10/1981 | Webb | |
| 4,305,193 A | * | 12/1981 | Anderson | 29/263 |
| 4,561,159 A | | 12/1985 | Schuster | |
| 4,780,942 A | | 11/1988 | Bernat | |
| 5,014,409 A | | 5/1991 | Hippach | |

FOREIGN PATENT DOCUMENTS

| | | |
|---|---|---|
| DE | 197 05 990 | 8/1998 |
| WO | 81 02538 | 9/1989 |

* cited by examiner

*Primary Examiner*—Robert C. Watson
(74) *Attorney, Agent, or Firm*—Kenyon & Kenyon

(57) ABSTRACT

A dismantling device is provided for dismantling a fuel injector from a mounting bore in a cylinder head of an internal combustion engine. The dismantling device has a jacket body, which at least partially surrounds the fuel injector, and has an engagement section, which engages with the fuel injector via of a contact face projecting radially inward. The engagement section of the jacket body surrounds the fuel injector only over a maximum angle range of 180° between two free ends. The contact face tapers in the direction of free ends of the engagement section.

16 Claims, 4 Drawing Sheets

DISMANTLING DEVICE FOR DISMANTLING A FUEL INJECTOR

This application is a division of U.S. patent application Ser. No. 09/600,713, filed Sep. 22, 2000, now U.S. Pat. No. 6,397,445 which is a national stage application of International Patent Application No. PCT/DE99/02472.

FIELD OF THE INVENTION

The present invention relates to a dismantling device for dismantling a fuel injector, in particular a high-pressure direct injector, from a mounting bore in a cylinder head of an internal combustion engine. Fuel is injected directly into the combustion chamber of the internal combustion engine through this high-pressure direct injector.

BACKGROUND INFORMATION

German Published Patent Application No. 197 05 990 describes a dismantling device, which has a jacket body at least partially surrounding the fuel injector, can be used for dismantling a direct injecting fuel injector. At the time of assembly, the jacket body is already inserted into the mounting bore in the cylinder head together with the fuel injector. A first collar section provided on a first end of the jacket body can be connected in a non-positive manner to a mounting section of the fuel injector, which accommodates the first collar section. On a second end of the jacket body opposite the first end, there is a second collar section which presents an engagement face for a tool. A disadvantage of this dismantling device is that the connection of the dismantling device to the fuel injector is not optimized, and the force induction through the tool acting on the dismantling device can be improved. Another disadvantage is that the dismantling device must be mounted on the fuel injector before assembly and cannot be attached subsequently, e.g., when repair or replacement is required.

U.S. Pat. No. 4,561,159 describes a dismantling device for a diesel injection nozzle. An end area of the fuel injector opposite the spray orifice can be inserted at the side into a slit in the dismantling device. The dismantling device is not inserted into the mounting bore of the cylinder head and it does not remain in the mounting bore when assembled. The dismantling device described in U.S. Pat. No. 4,561,159 is instead a tool extension, which is attached to the fuel injector before dismantling the fuel injector. However, connecting the dismantling device to the fuel injector here is a relatively complicated process.

SUMMARY OF THE INVENTION

The dismantling device according to the present invention has the advantage that the dismantling device can be mounted on the fuel injector with relatively little effort, so that handling is greatly simplified. With the device according to the present invention, the fuel injector can be inserted at the side into the engagement section with little force because of the sickle-shaped, tapered design of the contact face. With the device according to claim 2, the engagement sections, which are designed to be narrow, may be snapped onto the fuel injector with a spring action. The dismantling device acts in an area relatively close to the spray section of the fuel injector, so that no axial dismantling force acts on the fuel injector. Therefore, parts that have a lower load capacity, in particular plastic injection-molded parts, can be used in the inlet section of the fuel injector.

If, as in the device according to the present invention, at least two narrow engagement sections are provided, separated from one another by recesses, it is advantageous if flattened areas or recesses are provided on the engagement sections, thereby weakening the flexural rigidity of the engagement sections. Therefore, the fuel injector can be inserted into the dismantling device with a lower force.

With the device according to the present invention, it is advantageous if a tubular section which completely surrounds the fuel injector is provided following the engagement section(s). This tubular section improves the stability of the dismantling device. Furthermore, it is possible to provide engagement elements for engaging a dismantling tool, such as elements in the form of boreholes passing through the tubular section. A tong-like tool, for example, can be inserted into these bores, so that the dismantling device can be gripped easily by this tong-like tool.

From the standpoint of the manufacturing technology, it may be advantageous for the dismantling device to be composed of multiple partial bodies. It may be advantageous for the partial bodies to have fastening elements on the tubular section, engaging in recesses on the adjacent partial bodies.

The dismantling device may be manufactured by rolling steel plate, for example. However, it is also possible to produce the dismantling device from a fiberglass-reinforced plastic by a plastic injection-molding method, for example.

DETAILED DESCRIPTION

Figure 1A:
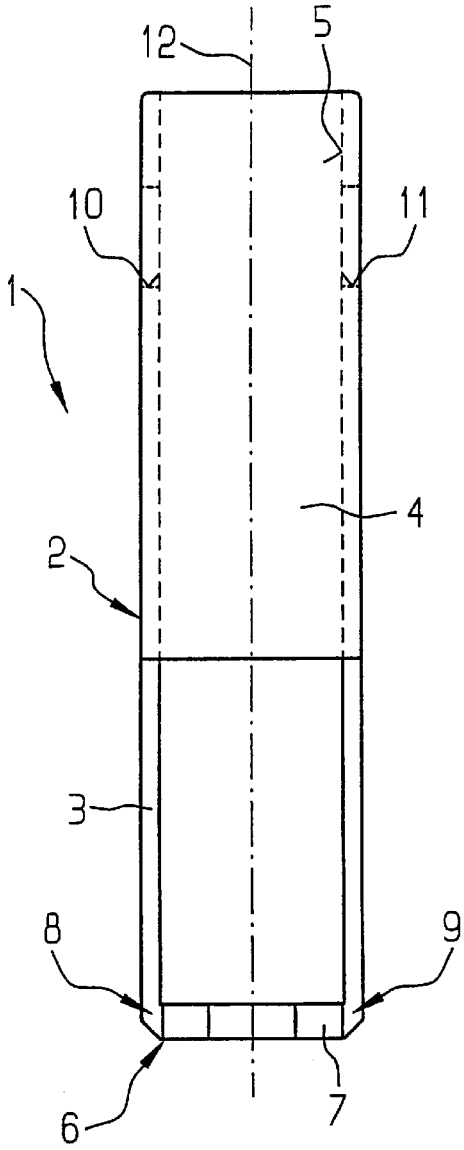
FIG. 1A shows an elevation of a first embodiment of a dismantling device according to the present invention.
Figure 1B:
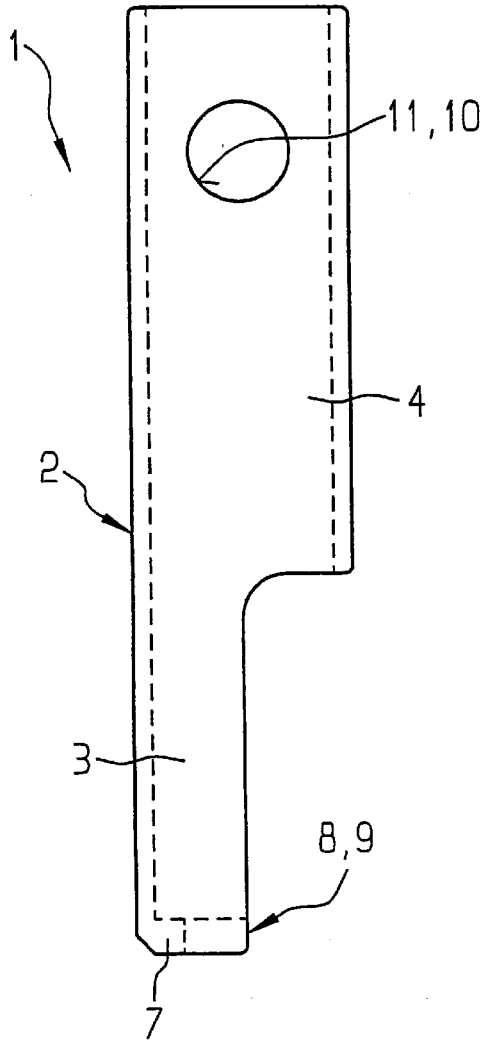
FIG. 1B shows a side view of the first embodiment illustrated in FIG. 1A.
Figure 1C:
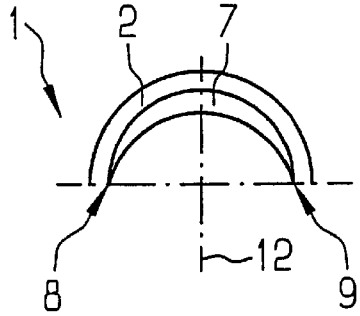
FIG. 1C shows a top view of the first embodiment illustrated in FIGS. 1A and 1B.

FIGS. 1A, 1B and 1C illustrate a first embodiment of the dismantling device according to the present invention. The dismantling device according to the present invention functions as an auxiliary tool in dismantling a fuel injector from a mounting bore in a cylinder head of an internal combustion engine for repair work or to replace the fuel injector.

The dismantling device 1 has a jacket body 2, which is divided into an engagement section 3 and a tubular section 4. In the embodiment illustrated here, engagement section 3 is designed in the form of a half pipe, which can be seen better in FIG. 1C, showing a top view of dismantling device 1 illustrated in FIG. 1A. An axial recess 5 passing completely through and completely surrounded by tubular section 4 opens at the forward end in the area of engagement section 3 in FIG. 1A and opens at the side in FIG. 1B, which shows a side view of the embodiment illustrated in FIG. 1A. Thus, the section of a fuel injector on the inlet end can be inserted into dismantling device 1 in such away that a contact face 7, which projects radially inward and is molded on end 6 of engagement section 3, opposite tubular section 4, can engage with the fuel injector in a suitable location.

According to the present invention, contact face 7 is designed in a sickle shape, i.e., contact face 7 tapers in its radial width in the direction of free ends 8 and 9 of engagement section 3. This sickle-shaped design of contact face 7 yields the result that dismantling device 1 can be attached to the fuel injector mounted on the cylinder head without any difficulty and without applying a great force. This yields improved guidance of dismantling device 1 and a lower required force when joining it to the fuel injector due to the narrow spur of contact face 7 in the direction of free ends 8 and 9 of engagement sections 3.

As shown in FIGS. 1A and 1B, two bores 10 and 11 are provided on tubular section 4 in this embodiment, extending at right angles to longitudinal axis 12 of dismantling device 1. Bores 10 and 11 function as engagement elements for a tool engaging with dismantling device 1. The tool may be designed like tongs, for example, with a first arm of the tongs being inserted into first bore 10 and a second arm of the tongs being inserted into second bore 11, so that dismantling device 1 can easily be gripped by the tong-like tool. It is also possible for crossbars to pass through both bores 10 and 11, with a suitable tool engaging with it for dismantling purposes or gripping it handily. Instead of bores 10 and 11, other engagement elements may of course also be provided for suitable tools, e.g., a collar projecting inward or outward on the end of tubular section 4 opposite engagement element 3.

Figure 2:
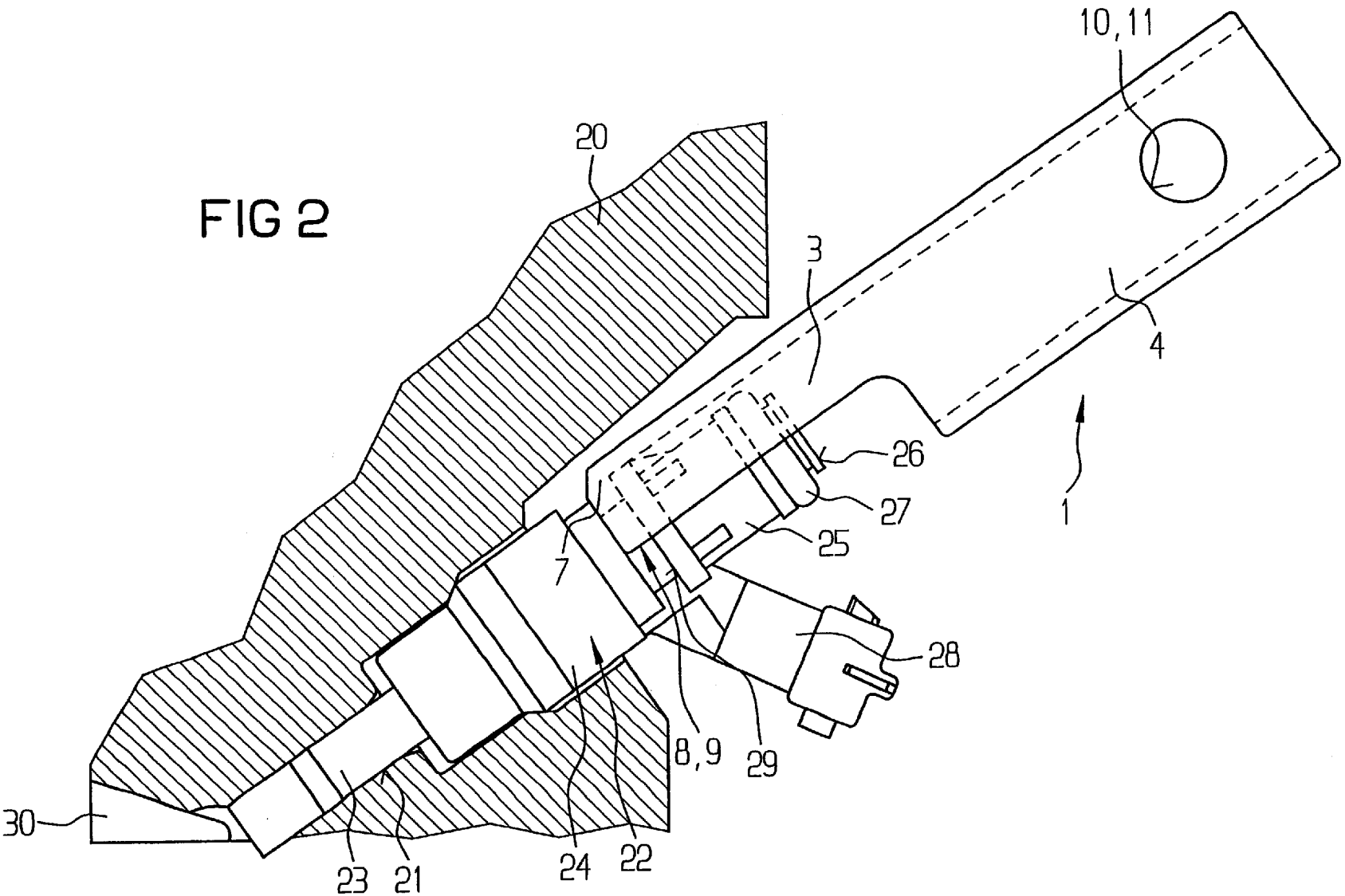
FIG. 2 shows a sectional view of a dismantling device according to the present invention mounted on a fuel injector inserted into a mounting bore in a cylinder head, according to the first embodiment illustrated in FIGS. 1A, 1B and 1C.

FIG. 2 shows a sectional view of cylinder head 20 of an internal combustion engine. A fuel injector 22 is inserted into a mounting bore 21 for direct injection of fuel into a combustion chamber 30 of the internal combustion engine. The elements of dismantling device 1 already described with reference to FIGS. 1A, 1B and 1C are labeled here with the same reference numbers, so the description need not be repeated in this regard.

Fuel injector 22 has a spray section 23, an intermediate section 24 and an inlet section 25. Inlet section 25 of fuel injector 22 has a fuel inlet opening 26, which can be connected to a fuel distributor line (not shown) and sealed by a sealing ring 27.

An electric connecting cable (not shown) can be connected to a plug connector 28 provided for electric operation of fuel injector 22. Plug connector 28 can be integrally molded on fuel injector 22, for example. An annular groove 29 is provided between plug connector 28 and intermediate section 24, so that contact face 7 of dismantling device 1 can engage with this groove. Therefore, for dismantling, a dismantling device 1 is inserted laterally into this groove 29 of fuel injector 22. As described previously, it is advantageous for contact face 7 to be designed in a sickle shape according to the present invention, i.e., it should taper toward free ends 8 and 9. This facilitates insertion of dismantling device 1, with contact face 7 exposing a relatively large opening between free ends 8 and 9, so the opening becomes progressively narrower. The design of contact face 7 according to the present invention therefore has a self-adjusting effect. After attaching or pushing dismantling device 1 onto fuel injector 22, the dismantling device can be gripped by a crossbar or by a tong-like tool at bores 10 and 11 as described above, so that fuel injector 22 can be pulled out of mounting bore 21 of cylinder head 20 for repair work or to be replaced. Tubular section 4 imparts a greater strength and stability to dismantling device 1.

Figure 3A:
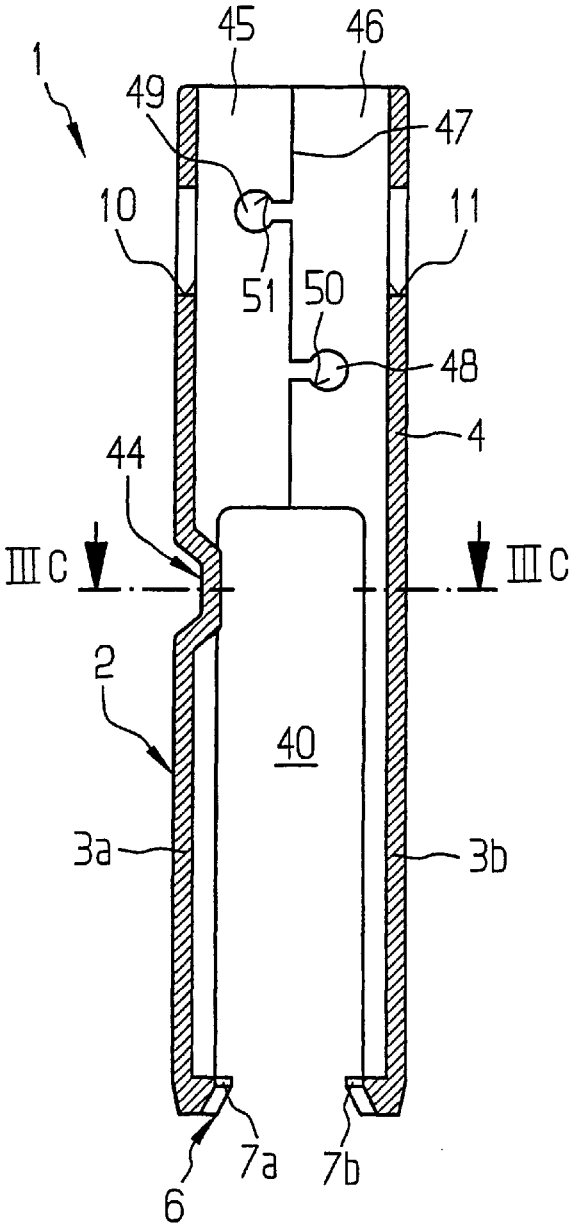
FIG. 3A shows a sectional elevation of a second embodiment of a dismantling device according to the present invention.
Figure 3B:
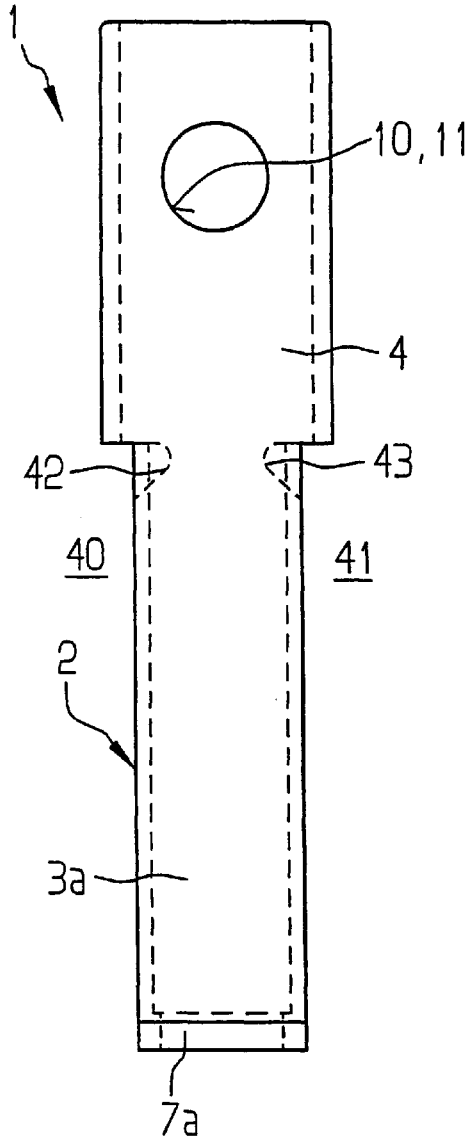
FIG. 3B shows a side view of the second embodiment illustrated in FIG. 3A.
Figure 3C:
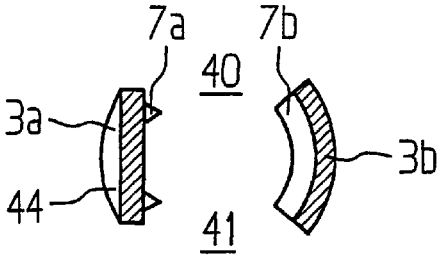
FIG. 3C a section along line IIIC—IIIC in FIG. 3A.

FIGS. 3A, 3B and 3C show a second embodiment of dismantling device 1 according to the present invention. Elements described above with reference to the embodiments illustrated in FIGS. 1A, 1B and 1C are labeled with the same reference numbers, so the description need not be repeated in this regard.

In contrast with the embodiment described with reference to FIGS. 1A through 1C, not only is there an engagement section 3 in the embodiments illustrated in FIGS. 3A through 3C, but also there are two diametrically opposed engagement sections 3*a* and 3*b*. Engagement sections 3*a* and 3*b* are separated by recesses 40 and 41. Engagement sections 3*a* and 3*b* are relatively narrow in shape and for example, cover a maximum angle range of 90°. Inward projecting contact faces 7*a* and 7*b* integrally molded on engagement sections 3*a* and 3*b* on end 6 opposite tubular section 4 and form, together with engagement sections 3*a* and 3*b*, catches that hook onto and engage a suitable engagement location on fuel injector 22. Multiple engagement sections, e.g., three or four engagement sections, may also be provided, for example distributed uniformly with equal distances between them on the circumference of tubular section 4.

To reduce the flexural rigidity of engagement sections 3*a* and 3*b* and thus facilitate the engagement of contact faces 7*a* and 7*b*, lateral flattened areas 44 may be provided, as illustrated in FIG. 3A. For the sake of simplicity, such a flattened area 44 is illustrated only for left engagement section 3*a* in FIG. 3A. Of course, right engagement section 3*b* on the opposite side could also be illustrated in the same way. As an alternative to flattened area 44, one or two lateral recesses 42, 43 may also be provided in the transition area between tubular section 4 and engagement sections 3*a* and 3*b*. Such lateral recesses 42 and 43 are illustrated in FIG. 3B, which shows a side view of the embodiment illustrated in FIG. 3A except for flattened area 44.

FIG. 3C shows a section along line IIIC—IIIC in FIG. 3A, with flattened area 44 illustrated clearly.

One particular feature of the embodiment illustrated in FIGS. 3A through 3C is that dismantling device 1 is composed of two partial bodies 45 and 46 joined together at a joint seam 47. Two partial bodies 45 and 46 can be produced independently of one another by rolling, for example, and then joined together as a butt seam at joint seam 47 or snapped together as shown in the embodiment here. If two partial bodies 45 and 46 are joined as a butt seam, they are joined, for example, by welding, soldering or the like. With the snap-lock joint illustrated in FIG. 3A, first partial body 45 has a first fastening element 48, while second partial body 46 has a second fastening element 49. First fastening element 48 of first partial body 45 engages behind a recess 50 adapted to the shape of fastening element 48, while second fastening element 49 of second partial body 46 engages behind a similarly shaped recess 51 in first partial body 45. Two partial bodies 45 and 46 may also be joined by welds or soldered seams. Joint seam 47 may also be such that fastening elements 48 and 49 do not engage behind recesses 50 and 51 but instead engage only in corresponding recesses. To do so, joint seam 47 may have a zigzag shape, for example.

Figure 4:
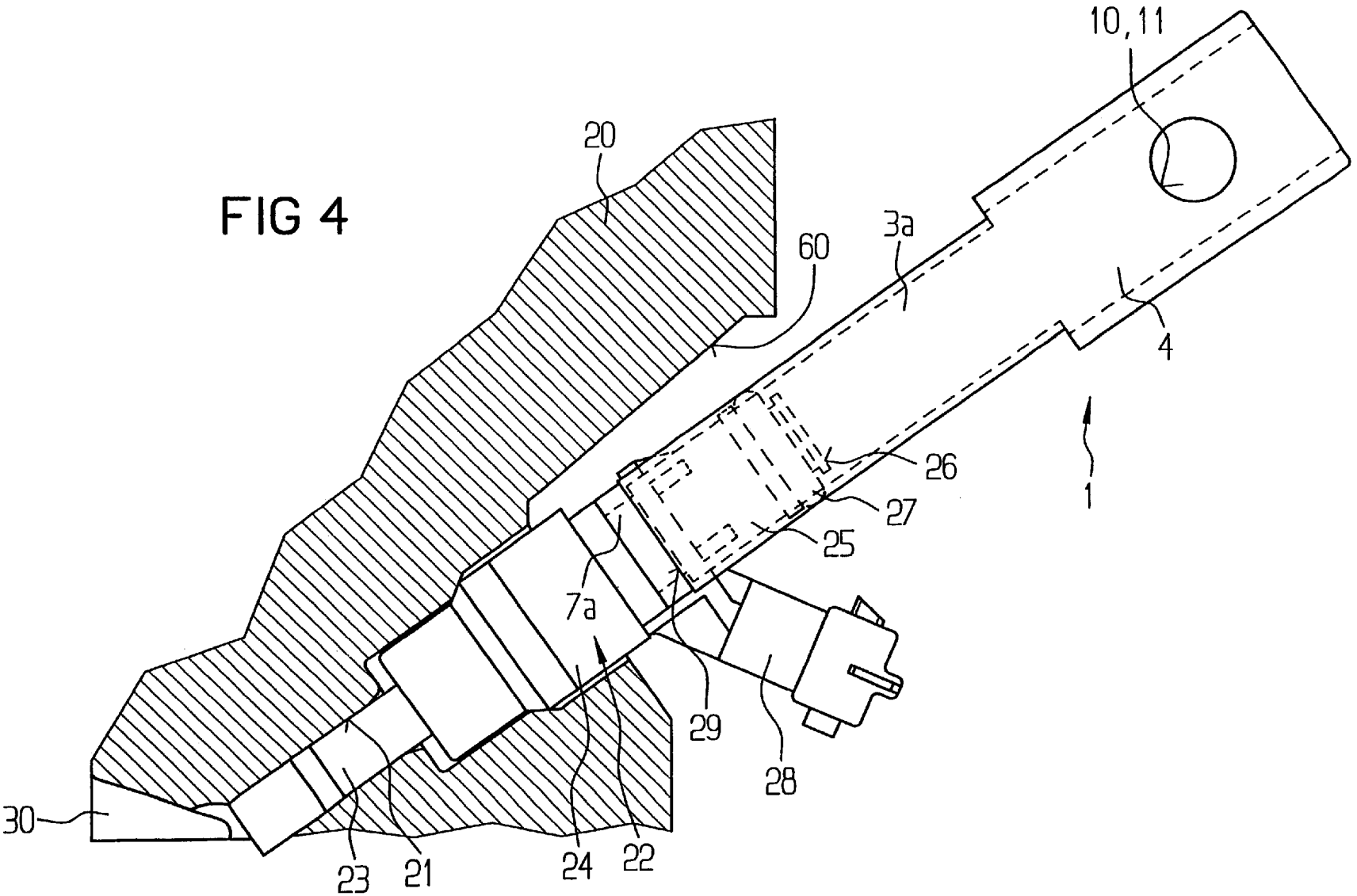
FIG. 4 shows a sectional view of a dismantling device according to the present invention mounted on a fuel injector inserted into a mounting bore in a cylinder head, according to the embodiment illustrated in FIGS. 3A, 3B and 3C.

In a diagram similar to that in FIG. 2, FIG. 4 shows a sectional view of cylinder head 20 of an internal combustion engine having a mounting bore 21 into which fuel injector 22 is inserted. Fuel injector 22 is designed in the same way as the fuel injector already described with reference to FIG. 2. However, a dismantling device 1 according to the second embodiment described with reference to FIGS. 3A through 3C engages with fuel injector 22. In this embodiment, contact faces 7*a* and 7*b* engage with groove 29 of fuel injector 22. In comparison with FIG. 2, however, it can be seen that dismantling device 1 is designed to be comparatively narrower according to the second embodiment, and it can therefore be inserted more easily into a trough 60 in cylinder head 20 and connected there more easily to fuel injector 22. In the embodiment illustrated on the basis of FIGS. 3A through 3C and 4, a suitable dismantling tool engages with bores 10 and 11.

What is claimed is:

1. A dismantling device for dismantling a fuel injector from a mounting bore in a cylinder head of an internal combustion engine, the device comprising:

a jacket body configured to at least partially surround the fuel injector, the jacket body including at least two narrow engagement sections configured to engage the fuel injector via a respective contact face projecting radially inward, the at least two narrow engagement sections being separated from one another by recesses, wherein at least one of flattened areas and recesses are provided on the at least two narrow engagement sections so as to weaken the flexural rigidity of the at least two narrow engagement sections.

2. The device according to claim 1, wherein:

the at least two narrow engagement sections are configured to surround the fuel injector only over a maximum angle range of 90°.

3. The device according to claim 1, further comprising:

a tubular section configured to completely surround the fuel injector, the tubular section following the at least two narrow engagement sections.

4. A dismantling device for dismantling a fuel injector from a mounting bore in a cylinder head of an internal combustion engine, the device comprising:

a jacket body configured to at least partially surround the fuel injector, the jacket body including at least two narrow engagement sections configured to engage the fuel injector via a respective contact face projecting radially inward, the at least two narrow engagement sections being separated from one another by recesses; and a tubular section configured to completely surround the fuel injector, the tubular section following the at least two narrow engagement sections, wherein:

the tubular section has at least one bore.

5. A dismantling device for dismantling a fuel injector from a mounting bore in a cylinder head of an internal combustion engine, the device comprising:

a jacket body configured to at least partially surround the fuel injector, the jacket body including at least two narrow engagement sections configured to engage the fuel injector via a respective contact face projecting radially inward, the at least two narrow engagement sections being separated from one another by recesses; and a tubular section configured to completely surround the fuel injector, the tubular section following the at least two narrow engagement sections, wherein:

the device is made from at least two partial bodies, the at least two partial bodies having fastening elements on the tubular section, the fastening elements engaging in recesses in adjacent partial bodies.

6. The device according to claim 3, wherein:

at least one contact face is provided on an end of each of the at least two narrow engagement sections opposite the tubular section.

7. The device according to claim 6, wherein:

the at least one contact face engages in a groove of the fuel injector.

8. The device according to claim 1, wherein:

the device is made of one of steel plate and fiberglass-reinforced plastic.

9. A The dismantling device according to claim 4, wherein:

the at least two narrow engagement sections are configured to surround the fuel injector only over a maximum angle of 90°.

10. The dismantling device according to claim 5, wherein:

the at least two narrow engagement sections are configured to surround the fuel injector only over a maximum angle of 90°.

11. The device according to claim 4, wherein:

the device is made of one of steel plate and fiberglass-reinforced plastic.

12. The device according to claim 5, wherein:

the device is made of one of steel plate and fiberglass-reinforced plastic.

13. The device according to claim 4, wherein:

at least one contact face is provided on an end of each of the at least two narrow engagement sections opposite the tubular section.

14. The device according to claim 13, wherein:

the at least one contact face engages in a groove of the fuel injector.

15. The device according to claim 5, wherein:

at least one contact face is provided on an end of each of the at least two narrow engagement sections opposite the tubular section.

16. The device according to claim 15, wherein:

the at least one contact face engages in a groove of the fuel injector.

* * * * *